United States Patent [19]

Walerowski

[11] 4,221,301

[45] Sep. 9, 1980

[54] CRANE TROLLEY WITH A HOIST

[75] Inventor: Reinhard Walerowski, Dusseldorf, Fed. Rep. of Germany

[73] Assignee: Heinrich de Fries Gesellschaft mit beschränkter Haftung, Düsseldorf, Fed. Rep. of Germany

[21] Appl. No.: 918,052

[22] Filed: Jun. 22, 1978

[30] Foreign Application Priority Data

Jun. 25, 1977 [DE] Fed. Rep. of Germany ..... 2728740

[51] Int. Cl.[2] ..... B66C 19/00

[52] U.S. Cl. ..... 212/134; 254/327

[58] Field of Search ..... 212/10–27, 212/71, 76–123, 134, 135; 254/167, 169, 171, 188, 189

[56] References Cited

U.S. PATENT DOCUMENTS

| | | | |
|---|---|---|---|
| 2,189,447 | 2/1940 | Martin | 254/167 |
| 2,919,109 | 12/1959 | Minty | 254/167 |
| 3,854,592 | 12/1974 | Mordre | 254/188 X |

FOREIGN PATENT DOCUMENTS

| | | | |
|---|---|---|---|
| 758137 | 1/1934 | France | 254/167 |

*Primary Examiner*—Stephen G. Kunin
*Assistant Examiner*—Edmond G. Rishell, Jr.
*Attorney, Agent, or Firm*—Martin A. Farber

[57] ABSTRACT

A crane trolley is movable by means of rollers on the lower flange of a runway girder, the crane trolley having a hoist, the latter being inserted in one of the two sides plates of the crane trolley. The load chain of the host is guided by means of guide rollers. The chain is fastened with one end to the crane trolley and is driven by the load chain wheel of the hoist and carries the lower block with the load hook. The hoist is arranged off-set in the longitudinal direction of the crane trolley relative to the lower block and the load chain is guided over two additional guide rollers in S-shape between the load chain wheel of the hoist and the pulling chain portion of the lower block.

4 Claims, 7 Drawing Figures

CRANE TROLLEY WITH A HOIST

FIELD OF THE INVENTION

The invention relates to a crane trolley which is movable by means of rollers on the lower flange of a runway girder, the crane trolley having a hoist, the latter being inserted in one of the two sides plates of the crane trolley and the load chain of the hoist is guided over guide deflection rollers, the chain being fastened with its one end to the crane trolley, and being driven by the load chain wheel of the hoist and carrying the lower block with the load hook.

Crane trolleys or crabs having a lifting tackle or hoist of the above-described type are already known. In addition to those of traditional construction, there are embodiments which are designed with regard to the smallest possible distance or spacing between the inner edge of the mouth of the hook and the lower edge of the runaway girder, i.e. the so-called "hook measure or value." These special embodiments are used in particular with limited space conditions.

In one known construction, the crane trolley has two lifting tackles or hoists, one arranged in one of the two side plates and the other being arranged in the other side plate, in such a manner that each pulling stringer portion or course of the hoists always moves perpendicularly or vertically to the lower block. While a small hook measure or value is thus obtained, on the other hand a relatively large structural height of the crane trolley as a whole must be put up with. Another disadvantage is that this known embodiment uses two different lift hoists, namely a left-driven or counter-clockwise and a right-driven or clockwise type of hoist, so that the quantities required in stock as well as repair and maintenance work are increased.

In another known embodiment of a crane trolley or crab having the smallest possible hook measure, use is made of a special hoist which is arranged in one of the two side plates of the crab, vertically above the pulling course portion of the load chain. Aside from the high expense for the special manufacture of the hoist, this known construction has the disadvantage of a large structural height of the crab.

SUMMARY OF THE INVENTION

The object of the present invention is to provide a crane trolley or crab for installation of an ordinary commercial hoist, which has the smallest possible hook value and the smallest possible structural height, which crab is capable of being produced from simple components and of being adapted to different runaway profiles at little expense.

This objective is achieved in accordance with the present invention in the manner, that the hoist is off-set or staggered in the longitudinal or lengthwise direction of the crane trolley with respect to the lower block and the load chain is guided by means of two additional guide deflection rollers in an S-shape between the load sprocket wheel of the hoist and the pulling course chain portion of the lower block which carries the load hook.

In accordance with another feature of the invention, an ordinary commercial hoist is inserted into a recess in one of the side plates, the hoist being preferably formed as a toothed or spurgear hoist, which is produced in large quantities and is thus at a low price.

By the off-setting of the hoist in the longitudinal direction of the crab and by the provision of additional guide deflection rollers, with the construction in accordance with the invention there can be obtained a minimum hook value, which is the result solely of the dimensions of the hook plus the width of the chain; in this case the structural height of the crab as a whole is not impaired. Due to the absence of drive shafts which are continuous or extend through, as a result of the arrangement of the hoist only on one side, which hoist is provided with its own drive, furthermore a simple adjustment of the crane trolley in the width is possible, so that adaptation to different runway profiles can be obtained without difficulty. Finally the construction of the invention, in view of the use of only one hoist in one of the side plates of the crane trolley, permits the simple installation of a traveling drive for the crab.

In one preferred embodiment of the invention, the load chain, between its attachment to one of the side plates of the crane trolley and the upper of the two additional guide deflection rollers on the other side plate, is guided over two chain wheels which are arranged on the lower block, the chain wheels being arranged laterally above the central yoke of the lower block. In this way there is obtained a double-strand formation for the load chain of the hoist, which permits a small structural height of the crane trolley without detrimentally affecting the smallest possible hook value. Furthermore, the development of the lower block has the result that in the highest position of the hook, the crane trolley can be held fast by the contact or engagement of the lower block against the bottom flange of the runway girder, and thus it can be secured against unintended traveling.

These advantages can be obtained in accordance with the invention, also by means of a four-strand embodiment of the load chain if, in accordance with a further feature of the invention, between its attachment to the bearing plate which receives the hoist and the upper of the two additional guide rollers, the load chain is guided over four chain wheels on the lower block, which chain wheels are arranged above the central yoke of the lower block, as well as over a guide deflection roller, the latter being arranged on the other side plate of the crane trolley at the height of the upper additional guide deflection roller.

BRIEF DESCRIPTION OF THE DRAWINGS

In the drawing, two embodiments of the crane trolley with hoist in accordance with the invention are shown.

DETAILED DESCRIPTION

Figure 1:
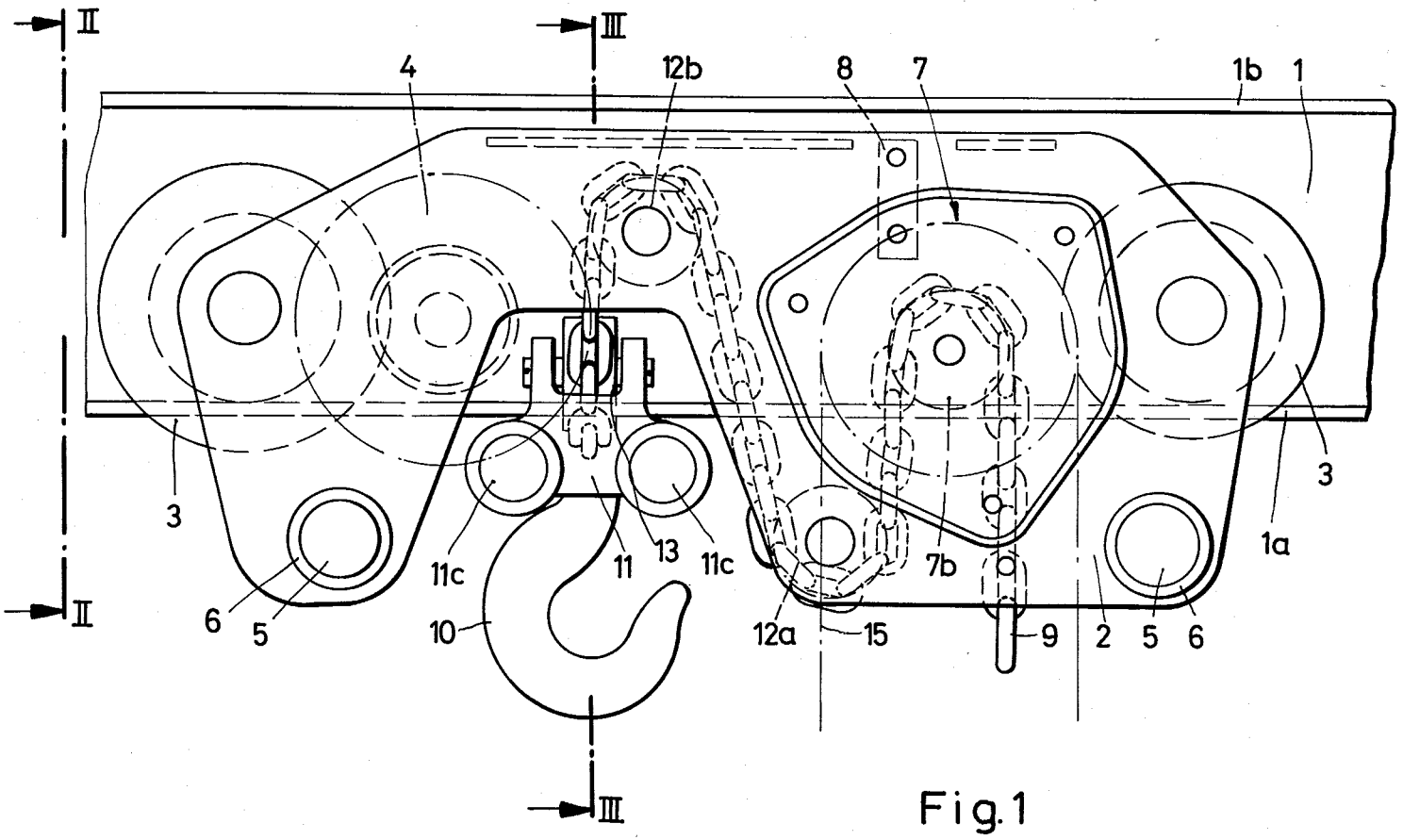
FIG. 1 is a side view of a first embodiment.
Figure 2:
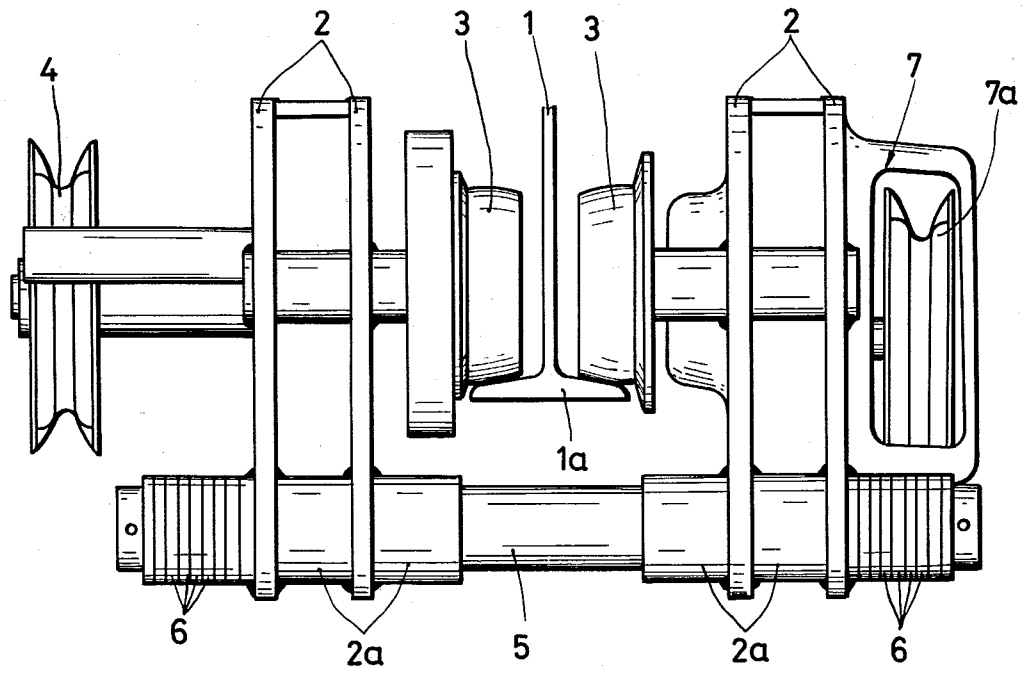
FIG. 2 is an end view according to the direction II—II of FIG. 1.
Figure 3:
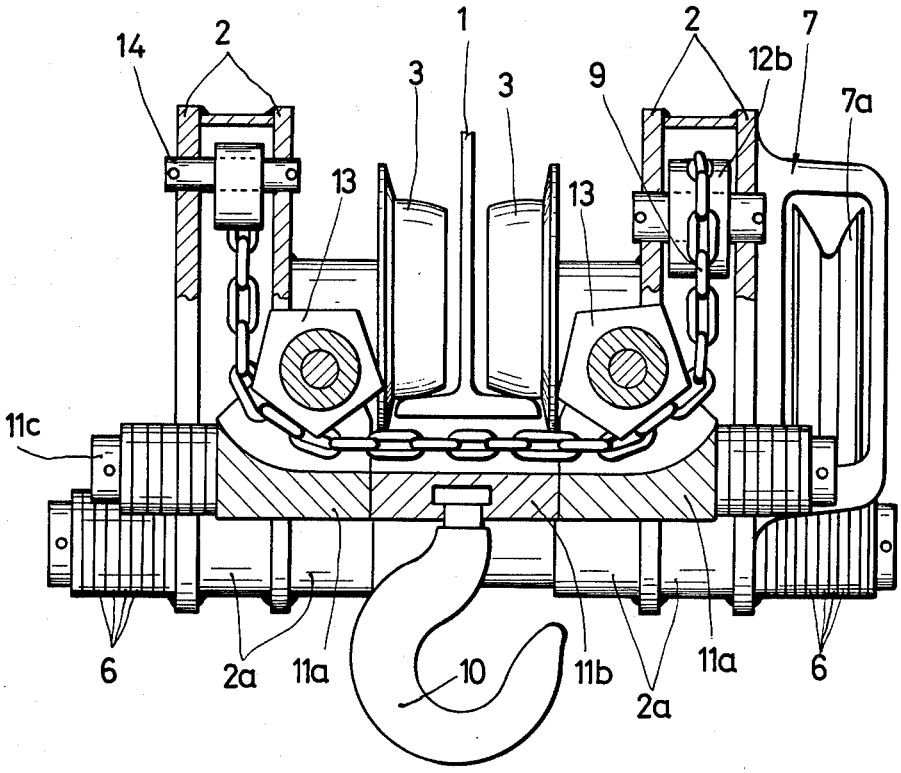
FIG. 3 is a cross section according to the section line III—III of FIG. 1.

The first embodiment, shown in FIGS. 1 to 3, comprises a crane trolley which can move on the lower flange 1*a* of a runway girder 1, the girder being fastened, for example, by its upper flange 1*b* to the ceiling of a room. The crane trolley or crab has two side plates 2 of box-like formation, on which respectively two traveling or running rollers 3 are rotatably mounted, the crane trolley being moveable along the runway girder or beam 1 by means of the rollers 3. In the embodiment shown, one of these rollers 3 is driven, namely by a manual chain or sprocket wheel 4, shown in FIGS. 1 and 2.

On the lower side of each side plate 2 there are fastened respectively two sleeves 2*a*. A transverse bolt 5 extends through the sleeves 2*a* (which sleeves are opposite each other) of the guide plates 2, which guide plates 2 are spaced apart from each other. By the insertion of spacer washers 6 on the outer and inner sides of the sleeves 2*a*, the distance of the two side plates 2 from each other can be adjusted in a simple manner in order to adapt the rollers 3 to the specific cross-sectional profile of the runway girder 1.

An ordinary commercial hoist 7 is arranged in a recess in one of the side plates 2, the drive sprocket wheel 7*a* of the hoist being visible in FIGS. 2 and 3. The load chain or sprocket wheel 7*b* of the hoist 7 can be noted in FIG. 1. The hoist 7 is an ordinary commercial spur or toothed gear hoist which is suspended by means of a fish plate or bracket 8 from the side plate 2.

Figure 4:
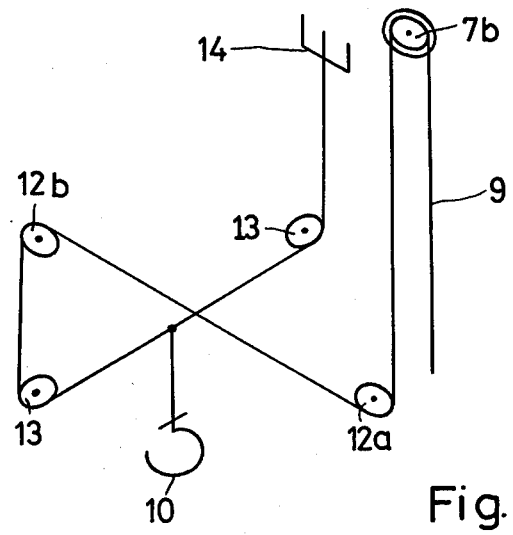
FIG. 4 is a schematic illustration of the course of the two-strand load chain of the first embodiment.

The hoist 7 is staggered or off-set in the longitudinal direction of the crane trolley with respect to the lower block 11 which carries the load hook 10, as can be noted in particular from FIG. 1. The load chain 9, which wraps around the load sprocket wheel 7*b*, is guided in an S-shape over two guide or deflection rollers 12*a*, 12*b* which are arranged on one of the side plates 2. From the upper guide roller 12*b*, the pulling course portion of the load chain 9 extends vertically downward. By means of two chain or sprocket wheels 13, (also acting as guide or deflection rollers) which are mounted on the lower block 11, the load chain 9 is guided to the other side plate 2 where the load chain is fastened by means of a bolt 14 at a point lying approximately opposite the guide roller 12*b*. In this way, there is obtained the two-strand path of the load chain 9 which is shown diagrammatically in FIG. 4.

In particular, FIGS. 1 and 3 show that by the lateral off-setting or staggering of the hoist 7 with respect to the lower block 11 in the longitudinal or lengthwise direction of the traveling crane trolley and by the S-shaped course of the load chain 9 over the two additional guide rollers 12*a* and 12*b*, there can be obtained, in the highest position of the load hook 10, a hook value (spacing between the inner edge of the jaw of the load hook 10 and the lower edge of the lower flange 1*a* of the runway girder 1) which is determined exclusively by the dimensions of the load hook 10 itself and by the cross-sectional dimensions of the load chain 9. Obtaining this smallest possible hook measure is favored by the fact that the chain wheels 13 which are arranged on the lower block 11 come to lie laterally alongside of or above the lower flange 1*a* of the runway girder 1 when the load hook 10 is in its highest position. Furthermore, as a result of the lateral arrangement of the chain wheels 13 on the lower block 1, it is possible to pull the lower block with the middle yoke 11*b* against the bottom flange 1*a* of the runway girder 1 and thus to hold the crane trolley fixed.

The driving of the hoist 7 is effected by means of a lifting chain 15, shown in dot-dashed line in FIG. 1, which chain drives the drive sprocket wheel 7*a* of the hoist 7. This ordinary commercial hoist 7 is inserted in a simple manner into a recess in the side plate 2 and is held fast by the aforementioned bracket 8. Of course, instead of the toothed or spur-gear hoist shown in the embodiment, some other conventional commercial hoist produced in large series construction can also be used.

The lower block 11 used in the embodiment which has been described above is composed of a plurality of parts (see FIG. 3). These parts comprise two side yokes 11*a*, a middle yoke 11*b*, and two carrying bolts 11*c*, which bolts connect the aforementioned yoke parts together. While the load hook 10 is fastened to the middle yoke 11*b*, each of the side yokes 11*a* carries one sprocket wheel 13. As a result of this embodiment, it is possible, without difficulty, also to adapt the lower block 11 to different spacings between the side plates 2, with consideration of adjustment to the prevailing cross-sectional shape of the runway girder 1.

Figure 7:
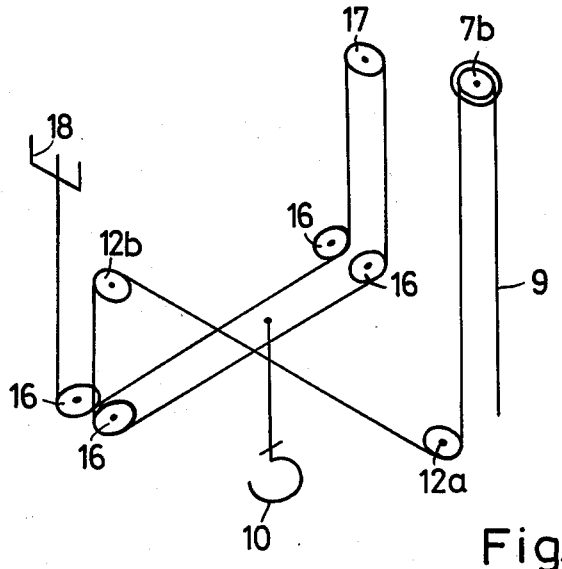
FIG. 7 is a schematic illustration corresponding to FIG. 4 of the course of the four-strand load chain.

The second embodiment (shown in FIGS. 5 and 6) of the crane trolley provided with a hoist 7 agrees in its basic construction with the first embodiment; it differs from it merely by a four-strand formation of the load chain 9, as shown diagrammatically in FIG. 7.

Figure 5:
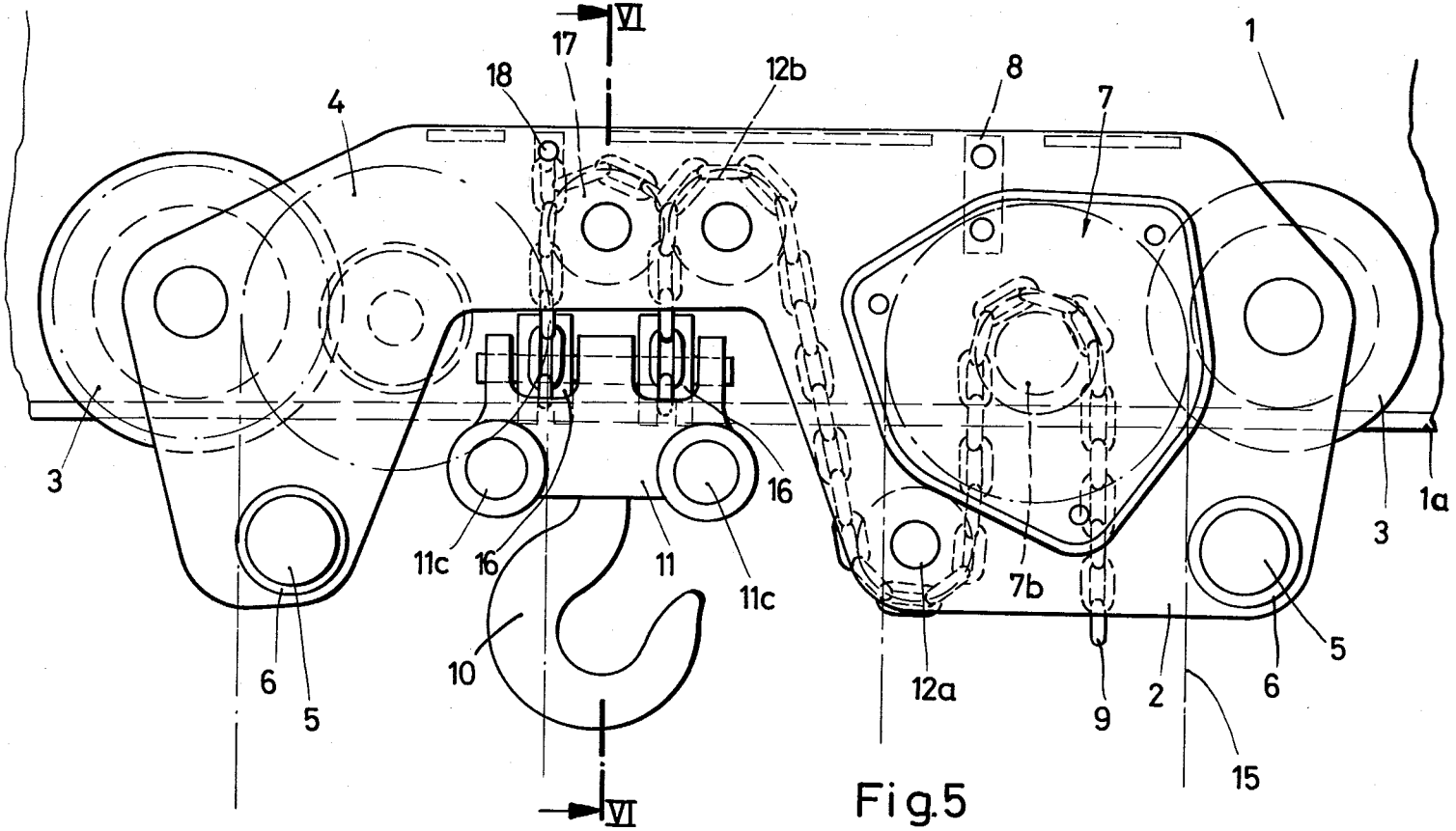
FIG. 5 is a side view of a second embodiment with a four-strand course of the load chain.
Figure 6:
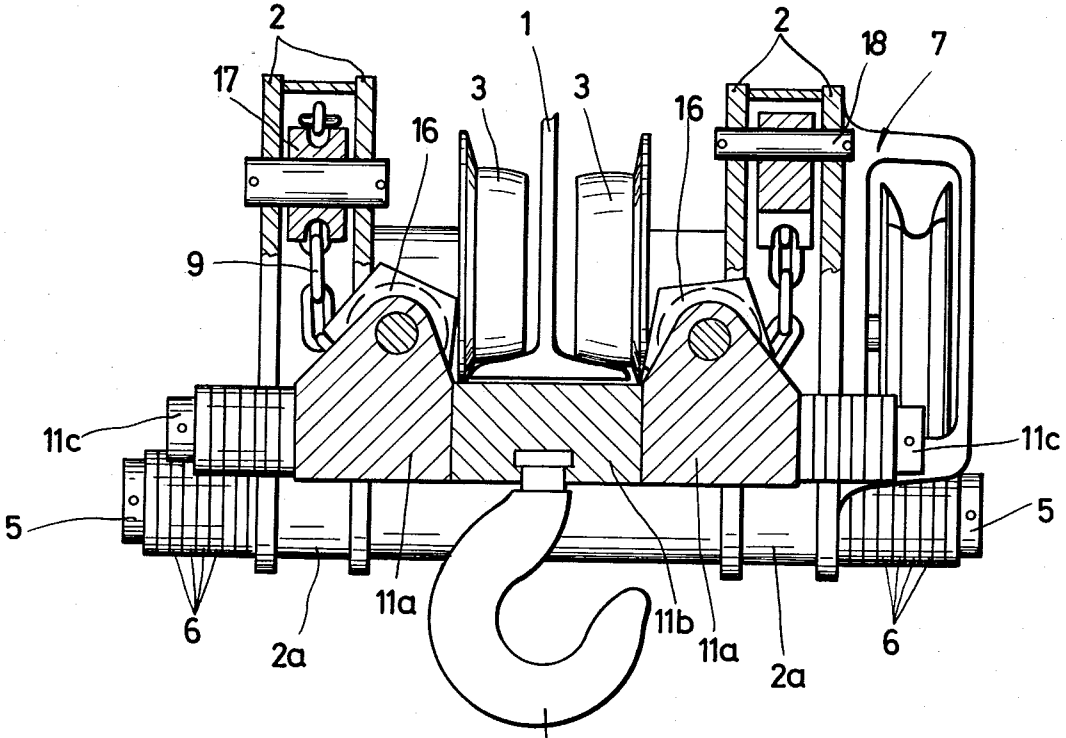
FIG. 6 is a cross section according to the section line VI—VI of FIG. 5.

This load chain 9 again wraps around the load sprocket wheel 7*b* of the hoist 7 which can be noted in FIG. 5. It also has an S-shaped path produced by two additional guide deflection rollers 12*a* and 12*b* between the pulling course portion of the load chain which extends vertically downwardly to the lower block 11 and the hoist 7. The four-strand development of the load chain 9 results from the provision of four chain or sprocket wheels 16 (also constituting guide deflection rollers) arranged on the lower block 11. The load chain 9 passes from the first of these sprocket wheels 16, the latter being arranged in the plane of that side plate 2 which is provided with the hoist 7, to a second chain or sprocket wheel 16 which lies in the plane of the other side plate 2, and from there the chain passes upwardly over a guide deflection roller 17, the latter being rotatably supported on this side plate 2, and from this guide roller 17 the chain passes downwardly to the third chain or sprocket wheel 16, and back from the latter to the fourth chain sprocket wheel 16, the latter in its turn being arranged in the plane of that side plate 2 in which the hoist 7 lies. From this fourth sprocket wheel 16 the load chain 9 extends vertically upwardly, where it is fastened by a bolt 18 to the bearing plate 2.

The parts of the crab in accordance with the second embodiment which have not been mentioned above correspond in their construction and their manner of operation to the parts which were described in connection with the first embodiment, for which reason they have been given the corresponding reference numbers. The lower block 11, which is composed of side yokes 11*a*, middle yoke 11*b*, and carrying bolt 11*c*, also is the same as or corresponds to the lower block 11 described above, except for the fact that in the second embodiment it carries a total of four chain or sprocket wheels 16. As can be noted from FIG. 6, these sprocket wheels 16 are also laterally above or alongside, respectively, the lower flange 1*a* of the runway girder 1 when the lower block 11 is in its uppermost position.

I claim:

1. A crane trolley which is movable by rollers on the lower flange of a runway girder, comprising a crane trolley having two side plates, a hoist being inserted in one of said two sides plates, said hoist including a load chain and a load chain wheel means for driving said load chain, guide rollers, said load chain being guided over said guide rollers and fastened with one end thereof to the crane trolley, a lower block carried by said load chain, a load hook being carried by said lower block, said hoist is arranged off-set with respect to said lower block in a longitudinal direction of the crane trolley, said guide rollers including two guide roller means for guiding said load chain thereon and therebetween in an S-shape between said load chain wheel means of said hoist and a pulling portion of the load chain of said lower block, one of said two guide roller means is disposed higher than the other of said two guide roller means and is mounted on said one side plate, means for attaching said one end of said load chain to the other of said side plates of the crane trolley, two guide chain wheel means for guiding said load chain between said attaching means and said one guide roller means, said lower block includes a central yoke, said two guide chain wheel means are arranged on said lower block, said two chain wheel means are arranged laterally above said central yoke of said lower block.

2. A crane trolley which is movable by rollers on the lower flange of a runway girder, comprising a crane trolley having two side plates, a hoist being inserted in one of said two sides plates, said hoist including a load chain and a load chain wheel means for driving said load chain, guide rollers, said load chain being guided over said guide rollers and fastened with one end thereof to the crane trolley, a lower block carried by said load chain, a load hook being carried by said lower block, said hoist is arranged off-set with respect to said lower block in a longitudinal direction of the crane trolley, said guide rollers including two guide roller means for guiding said load chain thereon and therebetween in an S-shape between said load chain wheel means of said hoist and a pulling portion of the load chain of said lower block, one of said two guide roller means is disposed higher than the other of said two guide roller means and is mounted on said one side plate, means for attaching said one end of said load chain to said one side plate, the latter constituting a bearing plate receiving the hoist, said lower block includes a central yoke, another guide roller means mounted on the other of said guide plates of the crane trolley at the height of said one guide roller means, four guide chain wheel means, and said another guide roller means, for guiding said load chain between said attaching means and said one guide roller means, said four guide chain wheel means are mounted on said lower block arranged laterally above said central yoke of said lower block.

3. The crane trolley according to claims 1 or 2, wherein said one side plate is formed with a recess, said hoist constitutes a conventional commercial hoist inserted into said recess in said one side plate.

4. The crane trolley according to claims 1 or 2, wherein said hoist is formed as a toothed gear hoist.

* * * * *